US005653626A

United States Patent [19]

Gottschald et al.

[11] Patent Number: 5,653,626

[45] Date of Patent: Aug. 5, 1997

[54] GRIPPING MEANS FOR HANDLING OPHTHALMIC LENSES

[75] Inventors: Lutz Gottschald, Meerbusch; Christian Weiss, Büttgen, both of Germany

[73] Assignee: Wernicke & Co, GmbH, Dusseldorf, Germany

[21] Appl. No.: 530,149

[22] PCT Filed: Jun. 1, 1994

[86] PCT No.: PCT/DE94/00611

§ 371 Date: Sep. 29, 1995

§ 102(e) Date: Sep. 29, 1995

[87] PCT Pub. No.: WO94/27782

PCT Pub. Date: Dec. 8, 1994

[30] Foreign Application Priority Data

Jun. 1, 1993 [DE] Germany ..... 43 18 138.4

[51] Int. Cl.[6] ..... B24B 41/06; B25B 11/00

[52] U.S. Cl. ..... 451/384; 269/21; 269/266; 451/388; 451/390

[58] Field of Search ..... 451/384, 388, 451/390; 269/21, 266

[56] References Cited

U.S. PATENT DOCUMENTS

| | | | |
|---|---|---|---|
| 4,684,113 | 8/1987 | Douglas et al. | 269/21 |

FOREIGN PATENT DOCUMENTS

| | | |
|---|---|---|
| 175431 | 3/1986 | European Pat. Off. . |
| 203905 | 12/1986 | France . |
| 1919248 | 4/1969 | Germany . |
| 2033858 | 6/1970 | Germany . |
| 58-71055(A) | 4/1983 | Japan . |
| 58-71056(A) | 4/1983 | Japan . |
| 1079373 | 3/1984 | U.S.S.R. . |

*Primary Examiner*—Timothy V. Eley

*Attorney, Agent, or Firm*—Antonelli, Terry, Stout & Kraus, LLP

[57] ABSTRACT

A device for processing ophthalmic lenses, which has at least one processing station for processing an edge and/or a surface of the ophthalmic lens and a multiaxial positioning unit, which has a gripping unit, which grips the ophthalmic lens and inserts it into a respective processing station and removes it therefrom. The gripping unit is provided with a plurality of vacuum grippers which are controlled by a control unit for applying a vacuum.

10 Claims, 2 Drawing Sheets

GRIPPING MEANS FOR HANDLING OPHTHALMIC LENSES

DESCRIPTION

1. Technical Field

The present invention relates to a device for processing ophthalmic lenses, which has at least one processing station for processing the edge and/or a surface of the ophthalmic lens and a multiaxial positioning unit, which has a gripping unit, which grips the ophthalmic lens and inserts it into the respective processing station respectively removes it therefrom.

2. State of the Art

Ophthalmic lenses are presently fabricated as follows:

First the actual manufacturer of the ophthalmic lens fabricates a so-called blank; this is understood to be a usually round, in some cases however also, a preedged ophthalmic lens, one side of which is finished. Subsequently, when a specific order is placed by an optician, the second surface is fabricated according to the respective prescription, and therefore also referred to as the prescription surface, by either the manufacturer himself or a so-called prescription lens grinder.

This round respectively only preedged ophthalmic lens but fabricated on both sides is then sent to the respective optician who edges the ophthalmic lens according to the frame that the customer has selected.

Recent attempts in reducing working steps and/or costs have increasingly tried to carry out the processing steps "fabrication of the prescription surface" and "edging the ophthalmic lens for the selected frame" on the same processing premises and if possible in the same device.

A short time ago, an older application of the applicant of the present invention, Wernicke & Co. GmbH, proposed automating the handling of ophthalmic lenses, in particular, in edging devices by by means of an industrial robot, thus a multiaxial positioning unit.

3. Description of the Invention

The object of the present invention is to improve a device for processing ophthalmic lenses, which has at least one processing station for processing the edge and/or a surface of the ophthalmic lens in a manner permitting simple handling of an ophthalmic lens and, in particular, inserting this ophthalmic lens in an edging and/or surface processing device.

The present invention is based on the fundamental idea of handling ophthalmic lenses using vacuum grippers. The use of vacuum grippers for handling objects is common knowledge. Hitherto, however they have not been utilized for handling ophthalmic lenses.

The reason for this is probably the general preconceived idea that vacuum grippers can only be attached to even surfaces and not to convex or concave ones, such as are usually the case with ophthalmic lenses.

As the (boundary) surfaces of an ophthalmic lens frequently even have a shape that is not rotationally symmetrical, by way of illustration, they have a toric shape or a purely aspherical one, such as progressive ophthalmic lenses have, an element of the present invention is that the gripping unit designed according to the present invention preferably is provided with multiple, comparatively small vacuum grippers. It can be assumed that, even in the case of a progressive surface of a progressive ophthalmic lens, that the surface at that area where the respective vacuum gripper acts is approximately rotationally symmetrical. Consequently, the so-called "cup" of the vacuum gripper lies completely flat on the surface.

Furthermore, according to the present invention it is advantageous if the gripping unit is provided with two "groups" of vacuum grippers which are disposed along a straight or curved line. In particular, the two groups of vacuum grippers can be disposed along both sides of a "U".

In another embodiment of the invented gripping unit, single vacuum grippers can be switched off and/or can be drawn back in the application direction in such a manner that even ophthalmic lenses of irregular shape, such as are required by frames of extreme shape, can be handled without risk.

The gripping unit designed according to the present invention can, by way of illustration in automation of a state of the art edging device, be applied to the concave side of the ophthalmic lens, with a so-called block for holding the ophthalmic lenses in the edging device being applied to the convex side in an as such known manner. The gripping unit designed according to the present invention therefore permits, by way of illustration, picking up a to-be-edged ophthalmic lens from a centering unit in which the block is placed without requiring the operator to supervise the insertion of the ophthalmic lens into the processing station.

DESCRIPTION OF PREFERRED EMBODIMENTS

Figure 1:
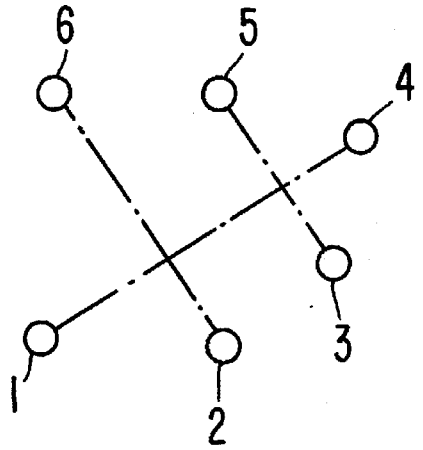
FIG. 1 shows a top view of a preferred embodiment of a vacuum gripping unit designed according to the present invention.
Figure 3:
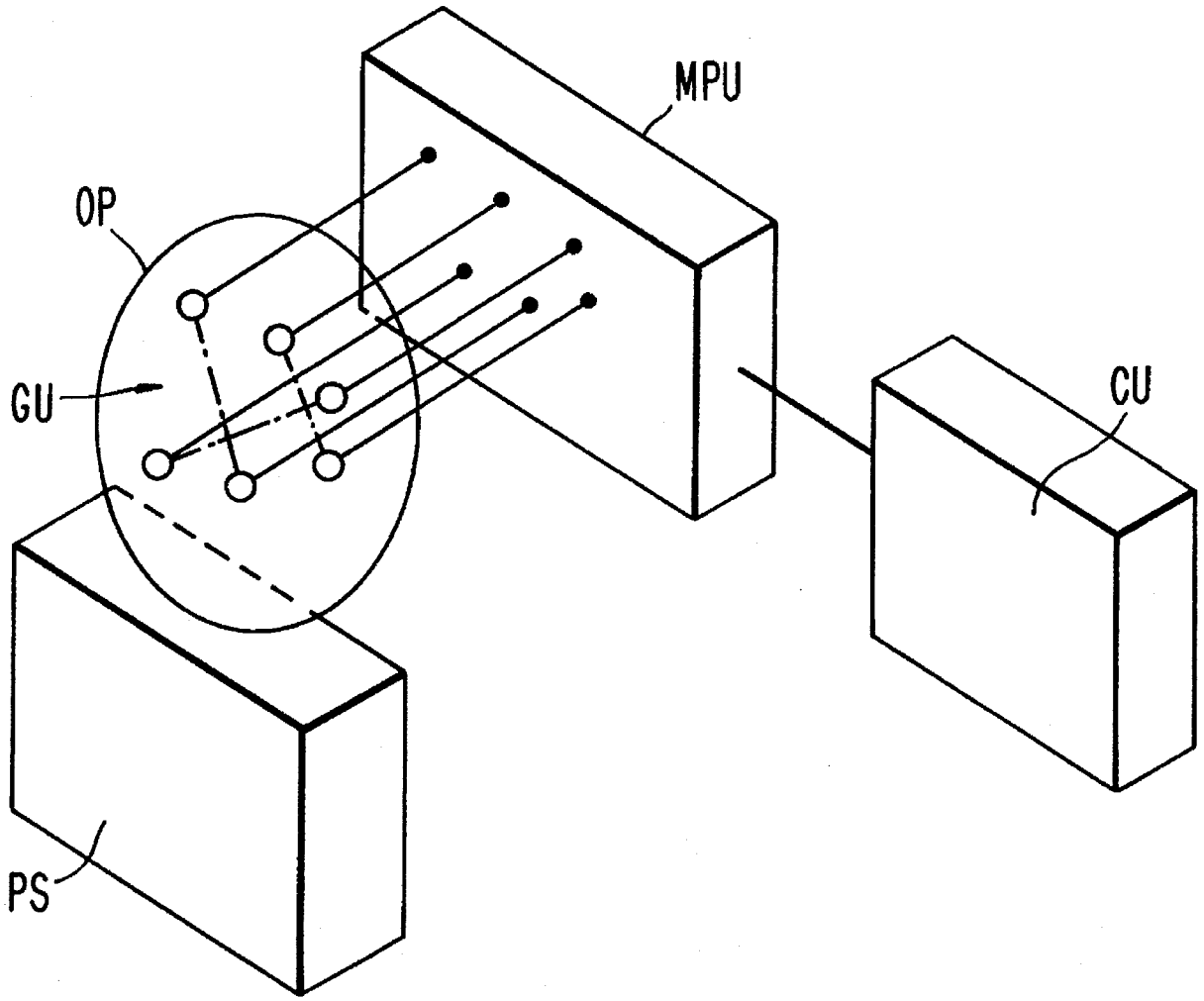
FIG. 3 shows a perspective view of a device for processing an ophthalmic lens according to the present invention.

FIG. 1 shows an invented vacuum gripping unit utilized for the insertion of an ophthalmic lens (OP) into a not depicted device as shown in FIG. 3 for processing ophthalmic lenses. This device is provided with at least one processing station (PS) for processing the edge and/or a surface of the ophthalmic lens (OP) and with a multiaxial positioning unit (MPU), at which the vacuum gripping unit (GU) is disposed. The positioning unit is utilized for positioning the vacuum gripping unit relative to the processing station respectively for the insertion respectively removal of the vacuum gripping unit into respectively out of the processing station.

The vacuum gripping unit is provided with multiple vacuum grippers 1 to 6 (as shown in FIG. 1), the diameter of which is distinctly smaller than the usual diameter of an ophthalmic lens as is shown in FIG. 3. The usual diameter of an ophthalmic lens ranges between 60 to 80 mm. The vacuum grippers provided with, in accordance with the present invention, have preferably a diameter which is smaller by a factor 3 than the diameter of the ophthalmic lens. The diameter of the so-called suction cup of the vacuum gripper preferably ranges from 5 to 15 mm.

In the case of the preferred embodiment, the individual vacuum grippers 1 to 6 of the vacuum gripping unit are disposed in the shape of a "U". Two vacuum grippers are coupled in such a manner that a control unit (CU), as shown in FIG. 3, applies them jointly by means of a vacuum. In the depicted preferred embodiment of FIG. 1, the vacuum grippers 1 and 4, 2 and 6, 3 and 5 are coupled in pairs in a pressure line manner along a straight line, thereby permitting, by switching off single pairs of vacuum grippers, adapting the gripping unit designed according to the present invention even to ophthalmic lenses having shapes of extreme design in such a manner that the ophthalmic lenses can be picked up and handled.

Figure 2:
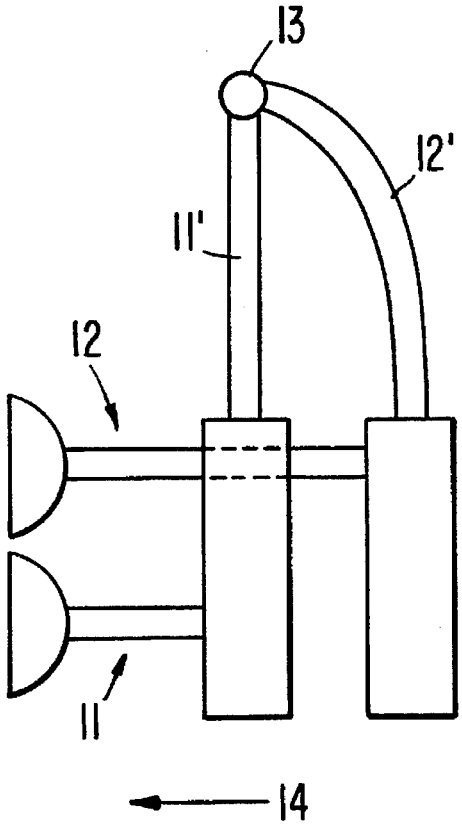
FIG. 2 shows a lateral view of another preferred embodiment.

FIG. 2 shows another preferred embodiment of the present invention. In this preferred embodiment, there are two groups 11 respectively 12 of vacuum grippers arranged in a straight line or a curved line, of which group 11 is attached to an arm 11' and group 12 to an arm 12', which can be rotated about a common point of rotation 13. A spring pretensions the two arms against each other. This embodiment permits drawing back a part of the vacuum grippers in the direction opposite to the application direction, which is symbolized by an arrow 14.

The invented vacuum gripping unit has, i.a., the advantage that following pick-up, the ophthalmic lens can be easily switched from a horizontal position to a vertical position by the multiaxial positioning unit (MPU). Furthermore, the preferred embodiment depicted in FIG. 2, in particular, permits placing an ophthalmic lens against a stop by means of drawing back a group of vacuum grippers. Moreover, by drawing back a part of the vacuum grippers, the gripping unit can be adapted to ophthalmic lenses of extreme shape.

For the vacuum grippers, vacuum gripper shapes may be utilized like those known from the state of the art of vacuum grippers used in handling crates. For this reason, a detailed description of the vacuum grippers is obviated.

The control unit which applies the individual vacuum gripper respectively vacuum grippers coupled in pairs by means of a vacuum applied thereto can be designed according to the state of the art so that a detailed description is obviated.

In any case, the device for processing ophthalmic lenses designed according to the present invention and having at least one processing station for processing the edge and/or a surface of the ophthalmic lens as well as having a multiaxial positioning unit permits picking up, handling and inserting an ophthalmic lens into a processing unit respectively removing it therefrom during the processing in a simple manner.

We claim:

1. A device for processing ophthalmic lenses, comprising at least one processing station for processing an edge and/or a surface of an ophthalmic lens, a gripping unit provided with a plurality of vacuum grippers for gripping the ophthalmic lens, a multiaxial positioning unit coupled to the gripping unit for enabling insertion of the ophthalmic lens gripped by the gripping unit into and away from a respective one of the at least one processing station, and a control unit coupled with the gripping unit for controlling application of a vacuum to the plurality of vacuum grippers, wherein each of the plurality of vacuum grippers has a diameter substantially smaller than the diameter of the ophthalmic lens, the diameter of the ophthalmic lens being in the range of 60 mm to 80 mm.

2. A device according to claim 1, wherein the plurality of vacuum grippers are disposed in two groups, each of the two groups being disposed along one of a straight line and a curved line.

3. A device according to claim 2, wherein the two groups are arranged in the form of a "U".

4. A device according to one of claims 1 to 3, wherein the control unit enables control of application of a vacuum to individual ones of the plurality of vacuum grippers.

5. A device according to one of claims to 4, wherein the gripper unit includes means enabling movement of at least one of the plurality of vacuum grippers in a direction opposite to an application direction of others of the plurality of vacuum grippers.

6. A device according to one of claims 1 to 3, wherein two of the plurality of vacuum grippers are coupled so that the control unit controls application of a vacuum jointly thereto.

7. A device according to claim 6, wherein the two of the plurality of vacuum grippers jointly controlled are spaced along a straight line.

8. A device according to claim 6, wherein the gripper unit includes means enabling movement of at least one of the plurality of vacuum grippers in a direction opposite to an application direction of others of the plurality of vacuum grippers.

9. A device according to claim 1, wherein the diameter of each of the plurality of vacuum grippers is smaller than the diameter of the ophthalmic lens by a factor of about 3.

10. A device according to claim 1, wherein the diameter of each of the plurality of vacuum grippers is in a range of about 5 mm to 15 mm.

* * * * *